US012637780B2

(12) United States Patent
Kanezawa et al.

(10) Patent No.: US 12,637,780 B2
(45) Date of Patent: May 26, 2026

(54) ORGANIC HYDRIDE PRODUCTION SYSTEM, CONTROL DEVICE FOR ORGANIC HYDRIDE PRODUCTION SYSTEM, AND CONTROL METHOD FOR ORGANIC HYDRIDE PRODUCTION SYSTEM

(71) Applicant: ENEOS Corporation, Tokyo (JP)

(72) Inventors: Miyuki Kanezawa, Tokyo (JP); Toru Takamura, Tokyo (JP); Koji Matsuoka, Tokyo (JP)

(73) Assignee: ENEOS CORPORATION, Tokyo (JP)

( * ) Notice: Subject to any disclaimer, the term of this patent is extended or adjusted under 35 U.S.C. 154(b) by 560 days.

(21) Appl. No.: 18/253,837

(22) PCT Filed: Dec. 2, 2021

(86) PCT No.: PCT/JP2021/044348

§ 371 (c)(1),
(2) Date: May 22, 2023

(87) PCT Pub. No.: WO2022/118933

PCT Pub. Date: Jun. 9, 2022

(65) Prior Publication Data

US 2024/0003027 A1 Jan. 4, 2024

(30) Foreign Application Priority Data

Dec. 4, 2020 (JP) ..... 2020-201824

(51) Int. Cl.
*C25B 15/023* (2021.01)
*C25B 3/03* (2021.01)
*C25B 15/08* (2006.01)

(52) U.S. Cl.
CPC ..... *C25B 15/023* (2021.01); *C25B 3/03* (2021.01); *C25B 15/08* (2013.01)

(58) Field of Classification Search
None
See application file for complete search history.

(56) References Cited

U.S. PATENT DOCUMENTS 3,968,021 A * 7/1976 Rahn ..... C25B 15/08 204/256
2011/0233054 A1 9/2011 Robinson
(Continued)

FOREIGN PATENT DOCUMENTS

JP 2018080361 A 5/2018
WO 2012091128 A1 7/2012

OTHER PUBLICATIONS

International Preliminary Report on Patentability Chapter I (PCT/IB/373) with translation mailed on May 30, 2023 by The International Bureau of WIPO in corresponding International Patent Application No. PCT/JP2021/044348. (10 pages).
(Continued)

*Primary Examiner* — Alexander W Keeling
(74) *Attorney, Agent, or Firm* — BUCHANAN, INGERSOLL & ROONEY PC

(57) ABSTRACT

An organic hydride production system includes: an electrolytic bath having a cathode chamber, a first cathode opening, and a second cathode opening, in which the first cathode opening is disposed below the second cathode opening; a catholyte supply device capable of switching between supply of a catholyte from the first cathode opening to the cathode chamber and supply of the catholyte from the second cathode opening to the cathode chamber; and a control device that controls the catholyte supply device so as to form an upflow of the catholyte in the cathode chamber in a steady state and form a downflow of the catholyte in the cathode chamber under a predetermined condition.

8 Claims, 5 Drawing Sheets

(56) References Cited

U.S. PATENT DOCUMENTS

| | | | | |
|---|---|---|---|---|
| 2013/0087451 | A1* | 4/2013 | Hirashige | C25B 11/073 204/263 |
| 2013/0313127 | A1 | 11/2013 | Sato et al. | |
| 2019/0264340 | A1 | 8/2019 | Mitsushima et al. | |
| 2019/0352786 | A1 | 11/2019 | Mitsushima et al. | |

OTHER PUBLICATIONS

International Search Report (PCT/ISA/210) with translation mailed on Jan. 11, 2022 by the Japanese Patent Office as the International Searching Authority for International Application No. PCT/JP2021/044348. (5 pages).

Extended European Search Report issued on Apr. 4, 2025, in corresponding European Patent Application No. 21900683.0. (9 pages).

* cited by examiner

ORGANIC HYDRIDE PRODUCTION SYSTEM, CONTROL DEVICE FOR ORGANIC HYDRIDE PRODUCTION SYSTEM, AND CONTROL METHOD FOR ORGANIC HYDRIDE PRODUCTION SYSTEM

CROSS-REFERENCE TO RELATED APPLICATIONS

This application is based upon and claims the benefit of priority from the prior Japanese Patent Application No. 2020-201824, filed on Dec. 4, 2020, and International Patent Application No. PCT/JP2021/044348, filed on Dec. 2, 2021, the entire content of each of which is incorporated herein by reference.

BACKGROUND

Field of the Invention

The present invention relates to an organic hydride production system, a control device for an organic hydride production system, and a control method for an organic hydride production system.

Description of the Related Art

In recent years, in order to suppress the carbon dioxide emission amount in the energy generation process, renewable energy is expected to be used, which is obtained by solar light, wind power, hydraulic power, geothermal power generation, and the like. As an example, a system for generating hydrogen by performing water electrolysis using power derived from renewable energy has been devised. In addition, an organic hydride system has attracted attention as an energy carrier for large-scale transportation and storage of hydrogen derived from renewable energy.

Regarding a technique for producing an organic hydride, a conventional organic hydride production system including an electrolytic bath having an oxidation electrode for generating protons from water and a reduction electrode for hydrogenating an organic compound (substance to be hydrogenated) having an unsaturated bond is known (see, for example, Patent Literature 1). In this organic hydride production system, a current flows between the oxidation electrode and the reduction electrode while water is supplied to the oxidation electrode, and a substance to be hydrogenated is supplied to the reduction electrode, so that hydrogen is added to the substance to be hydrogenated to obtain an organic hydride.

Patent Literature 1: WO2012/091128A

As a result of intensive studies on the above-described technique for producing an organic hydride, the present inventors have recognized that there is room for improvement in the Faraday efficiency (current efficiency) of the organic hydride production system in the conventional technique.

SUMMARY OF THE INVENTION

The present invention has been made in view of such a situation, and an object thereof is to provide a technique for improving the Faraday efficiency of an organic hydride production system.

One aspect of the present invention is an organic hydride production system. This organic hydride production system includes: an electrolytic bath having a cathode chamber accommodating a cathode electrode for hydrogenating a substance to be hydrogenated in a catholyte with protons to generate an organic hydride, and a first cathode opening and a second cathode opening communicating with the inside and the outside of the cathode chamber, the first cathode opening being disposed below the second cathode opening; a catholyte supply device capable of switching between supply of the catholyte from the first cathode opening to the cathode chamber and supply of the catholyte from the second cathode opening to the cathode chamber; and a control device controlling the catholyte supply device so as to form an upflow of the catholyte in the cathode chamber by supplying the catholyte from the first cathode opening to the cathode chamber in a steady state, and form a downflow of the catholyte in the cathode chamber by supplying the catholyte from the second cathode opening to the cathode chamber under a predetermined condition.

Another aspect of the present invention is a control device for an organic hydride production system including an electrolytic bath and a catholyte supply device. The electrolytic bath has a cathode chamber accommodating a cathode electrode for hydrogenating a substance to be hydrogenated in a catholyte with protons to generate an organic hydride, and a first cathode opening and a second cathode opening communicating with the inside and the outside of the cathode chamber, and the first cathode opening is disposed below the second cathode opening. The catholyte supply device is capable of switching between supply of the catholyte from the first cathode opening to the cathode chamber and supply of the catholyte from the second cathode opening to the cathode chamber. The control device controls the catholyte supply device so as to form an upflow of the catholyte in the cathode chamber by supplying the catholyte from the first cathode opening to the cathode chamber in a steady state, and form a downflow of the catholyte in the cathode chamber by supplying the catholyte from the second cathode opening to the cathode chamber under a predetermined condition.

Another aspect of the present invention is a control method for an organic hydride production system including an electrolytic bath having a cathode chamber accommodating a cathode electrode for hydrogenating a substance to be hydrogenated in a catholyte with protons to generate an organic hydride. The control method includes: forming an upflow of the catholyte in the cathode chamber in a steady state; and forming a downflow of the catholyte in the cathode chamber under a predetermined condition.

Any combinations of the above components and conversion of the expressions in the present disclosure between methods, devices, systems, and the like are also effective as aspects of the present disclosure.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
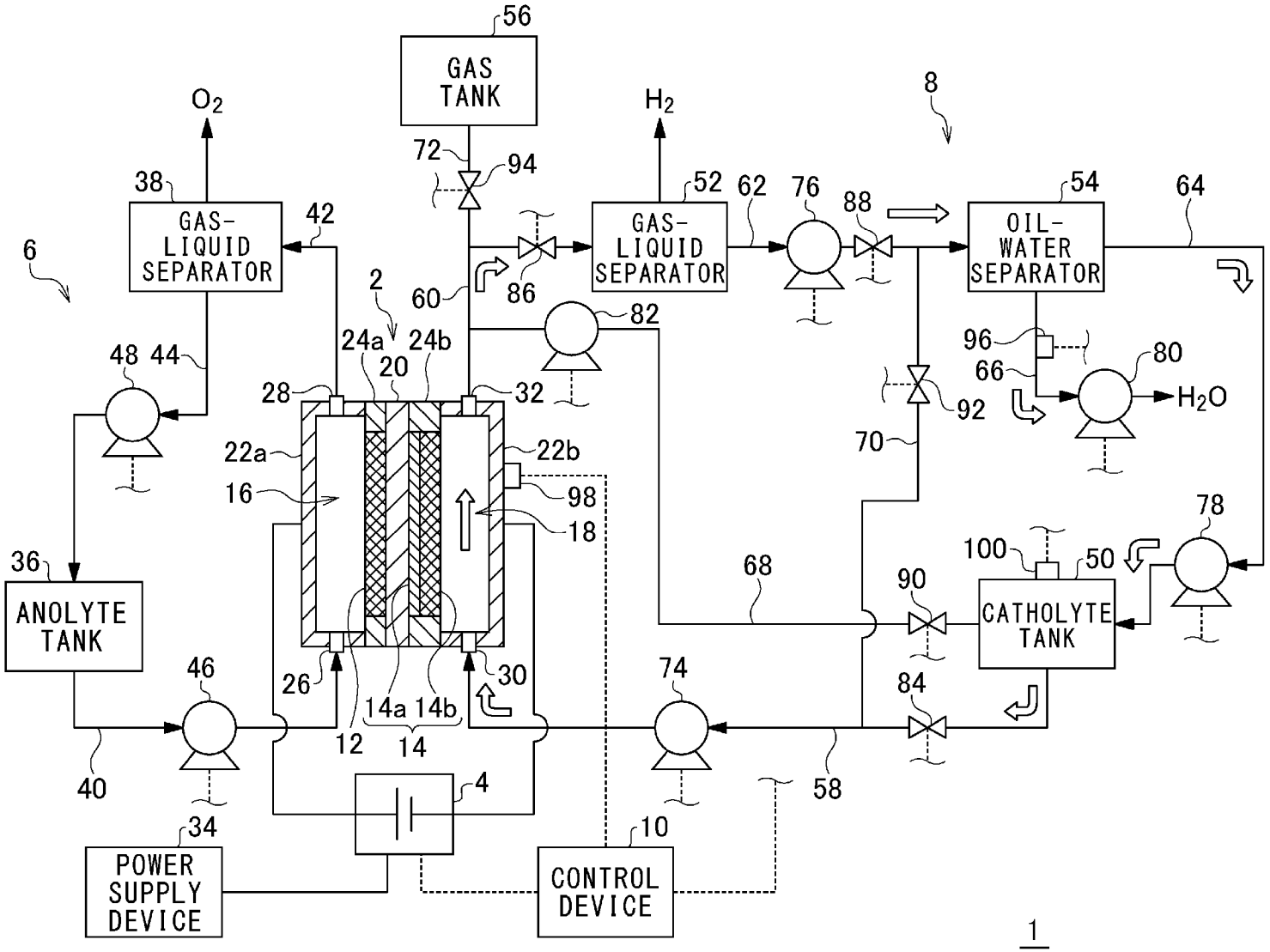
FIG. 1 is a schematic view showing an organic hydride production system according to an embodiment and a first path of a catholyte.

Hereinafter, the present invention will be described based on preferred embodiments with reference to the drawings. The embodiments are illustrative rather than limiting the invention, and all features described in the embodiments and combinations thereof are not necessarily essential to the invention. The same or equivalent components, members, and processes illustrated in the drawings are denoted by the same reference numerals, and redundant description will be omitted as appropriate.

In addition, the scale and shape of each part illustrated in each drawing are set for convenience in order to facilitate the description, and are not to be limitedly interpreted unless otherwise specified. Furthermore, when the terms "first", "second", and the like are used in the present specification or claims, the terms do not represent any order or importance, but are used to distinguish one configuration from another configuration. In addition, in each drawing, some of members that are not important for describing the embodiments are omitted.

FIG. 1 is a schematic view showing an organic hydride production system 1 according to an embodiment and a first path of a catholyte. The organic hydride production system 1 includes an electrolytic bath 2, a power supply 4, an anolyte supply device 6, a catholyte supply device 8, and a control device 10 as a main configuration.

The electrolytic bath 2 generates an organic hydride by hydrogenating a substance to be hydrogenated which is a dehydrogenated product of the organic hydride by an electrochemical reduction reaction. The electrolytic bath 2 has an anode electrode 12, a cathode electrode 14, an anode chamber 16, a cathode chamber 18, and a diaphragm 20.

The anode electrode 12 (anode) oxidizes water in the anolyte to generate protons. The anode electrode 12 has, for example, a metal such as iridium (Ir), ruthenium (Ru), or platinum (Pt), or a metal oxide thereof as an anode catalyst. The anode catalyst may be dispersedly supported or coated on a base material having electron conductivity. The base material includes a material containing, for example, a metal such as titanium (Ti) or stainless steel (SUS) as a main component. Examples of the form of the base material include a woven fabric sheet or a nonwoven fabric sheet, a mesh, a porous sintered body, a foamed molded body (foam), and an expanded metal.

The cathode electrode 14 (cathode) hydrogenates a substance to be hydrogenated in the catholyte with protons to generate an organic hydride. The cathode electrode 14 of the present embodiment has a catalyst layer 14*a* and a diffusion layer 14*b*. The catalyst layer 14*a* is disposed closer to the diaphragm 20 than the diffusion layer 14*b*. The catalyst layer 14*a* of the present embodiment is in contact with a main surface of the diaphragm 20. The catalyst layer 14*a* contains, for example, platinum or ruthenium as a cathode catalyst for hydrogenating the substance to be hydrogenated. It is preferable that the catalyst layer 14*a* also contains a porous catalyst support that supports the cathode catalyst. The catalyst support includes an electron-conductive material such as porous carbon, a porous metal, or a porous metal oxide.

Furthermore, the cathode catalyst is coated with an ionomer (cation exchange ionomer). For example, the catalyst support which is in the state of supporting the cathode catalyst is coated with an ionomer. Examples of the ionomer include a perfluorosulfonic acid polymer such as Nafion (registered trademark) or Flemion (registered trademark). It is preferable that the cathode catalyst is partially coated with the ionomer. As a result, it is possible to efficiently supply three elements (the substance to be hydrogenated, a proton, and an electron) necessary for an electrochemical reaction in the catalyst layer 14*a* to the reaction field.

The diffusion layer 14*b* uniformly diffuses a liquid substance to be hydrogenated supplied from the outside into the catalyst layer 14*a*. The organic hydride generated in the catalyst layer 14*a* is discharged to the outside of the catalyst layer 14*a* through the diffusion layer 14*b*. The diffusion layer 14*b* of the present embodiment is in contact with a main surface of the catalyst layer 14*a* on a side opposite to the diaphragm 20. The diffusion layer 14*b* includes a conductive material such as carbon or a metal. In addition, the diffusion layer 14*b* is a porous body such as a sintered body of fibers or particles or a foamed molded body. Specific examples of the material included in the diffusion layer 14*b* include a carbon woven fabric (carbon cloth), a carbon nonwoven fabric, and carbon paper.

The anode electrode 12 is accommodated in the anode chamber 16. The anode chamber 16 is defined by, for example, the diaphragm 20, an end plate 22*a*, and a spacer 24*a*. The end plate 22*a* is a plate material including a metal such as stainless steel or titanium, for example, and is installed on the side of the anode electrode 12 opposite to the diaphragm 20. The end plate 22*a* as an example has a groove-shaped flow path on a main surface facing the side of the anode electrode 12. The anolyte supplied to the anode chamber 16 is supplied to the anode electrode 12 through the flow path, and is discharged from the anode chamber 16 through the flow path. The spacer 24*a* is a frame-shaped seal material disposed between the diaphragm 20 and the end plate 22*a*. A space excluding the anode electrode 12 in the anode chamber 16 forms a flow path of the anolyte.

The end plate 22*a* is provided with a first anode opening 26 and a second anode opening 28 that communicate with the inside and the outside of the anode chamber 16. The first anode opening 26 is disposed below the second anode opening 28. In the present embodiment, the first anode opening 26 is provided on a bottom surface of the anode chamber 16, and the second anode opening 28 is provided on a top surface of the anode chamber 16. The first anode opening 26 and the second anode opening 28 may or may not overlap when viewed from a vertical direction.

The cathode electrode 14 is accommodated in the cathode chamber 18. The cathode chamber 18 is defined by, for example, the diaphragm 20, an end plate 22*b*, and a spacer 24*b*. The end plate 22*b* is a plate material including a metal such as stainless steel or titanium, for example, and is installed on the side of the cathode electrode 14 opposite to the diaphragm 20. The end plate 22*b* as an example has a groove-shaped flow path on a main surface facing the side of the cathode electrode 14. The catholyte supplied to the cathode chamber 18 is supplied to the cathode electrode 14 through the flow path, and is discharged from the cathode chamber 18 through the flow path. The spacer 24*b* is a frame-shaped seal material disposed between the diaphragm 20 and the end plate 22*b*. A space excluding the cathode electrode 14 in the cathode chamber 18 forms a flow path of the catholyte. Therefore, the flow path shape of the catholyte in the cathode chamber 18 is not limited.

The end plate 22*b* is provided with a first cathode opening 30 and a second cathode opening 32 that communicate with the inside and the outside of the cathode chamber 18. The first cathode opening 30 is disposed below the second cathode opening 32. In the present embodiment, the first cathode opening 30 is provided on a bottom surface of the cathode chamber 18, and the second cathode opening 32 is provided on a top surface of the cathode chamber 18. The first cathode opening 30 and the second cathode opening 32 may or may not overlap when viewed from the vertical direction. For example, the first cathode opening 30 and the second cathode opening 32 may be provided on a side surface of the cathode chamber 18.

In the present disclosure, the position of each cathode opening is defined by a position of an inner end, that is, a position of an opening provided on an inner wall surface of the cathode chamber 18. Therefore, "the first cathode opening 30 is disposed below the second cathode opening 32" means that the inner end of the first cathode opening 30 is disposed below the inner end of the second cathode opening 32. The cathode chamber 18 of the present embodiment is defined by the diaphragm 20, the end plate 22*b*, and the spacer 24*b*. The first cathode opening 30 and the second cathode opening 32 are provided in the end plate 22*b*. In this case, the position of the opening formed on the inner wall surface of the end plate 22*b* by each cathode opening becomes the position of each cathode opening.

Figure 2:
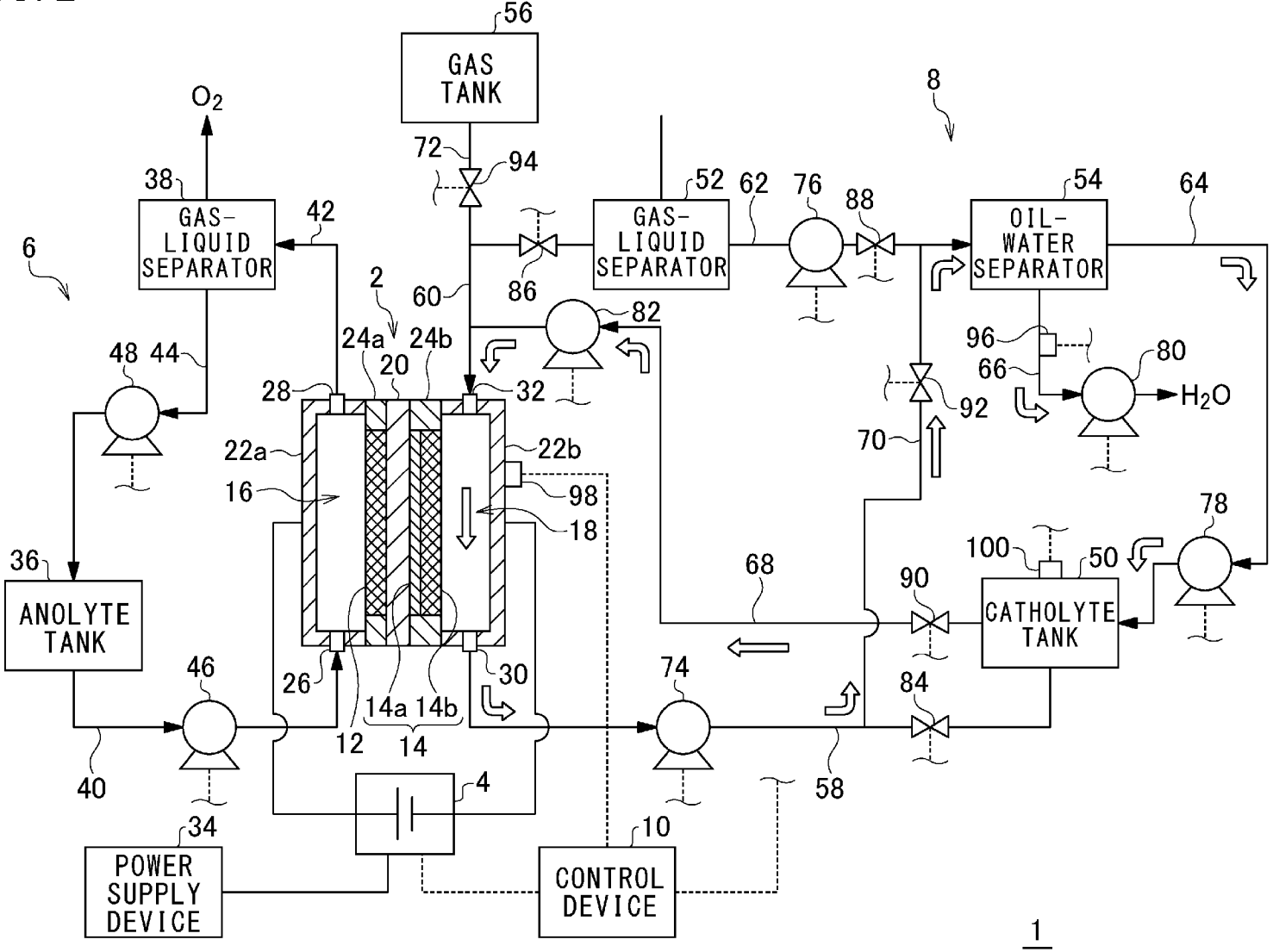
FIG. 2 is a schematic view showing a second path of a catholyte.
Figure 3:
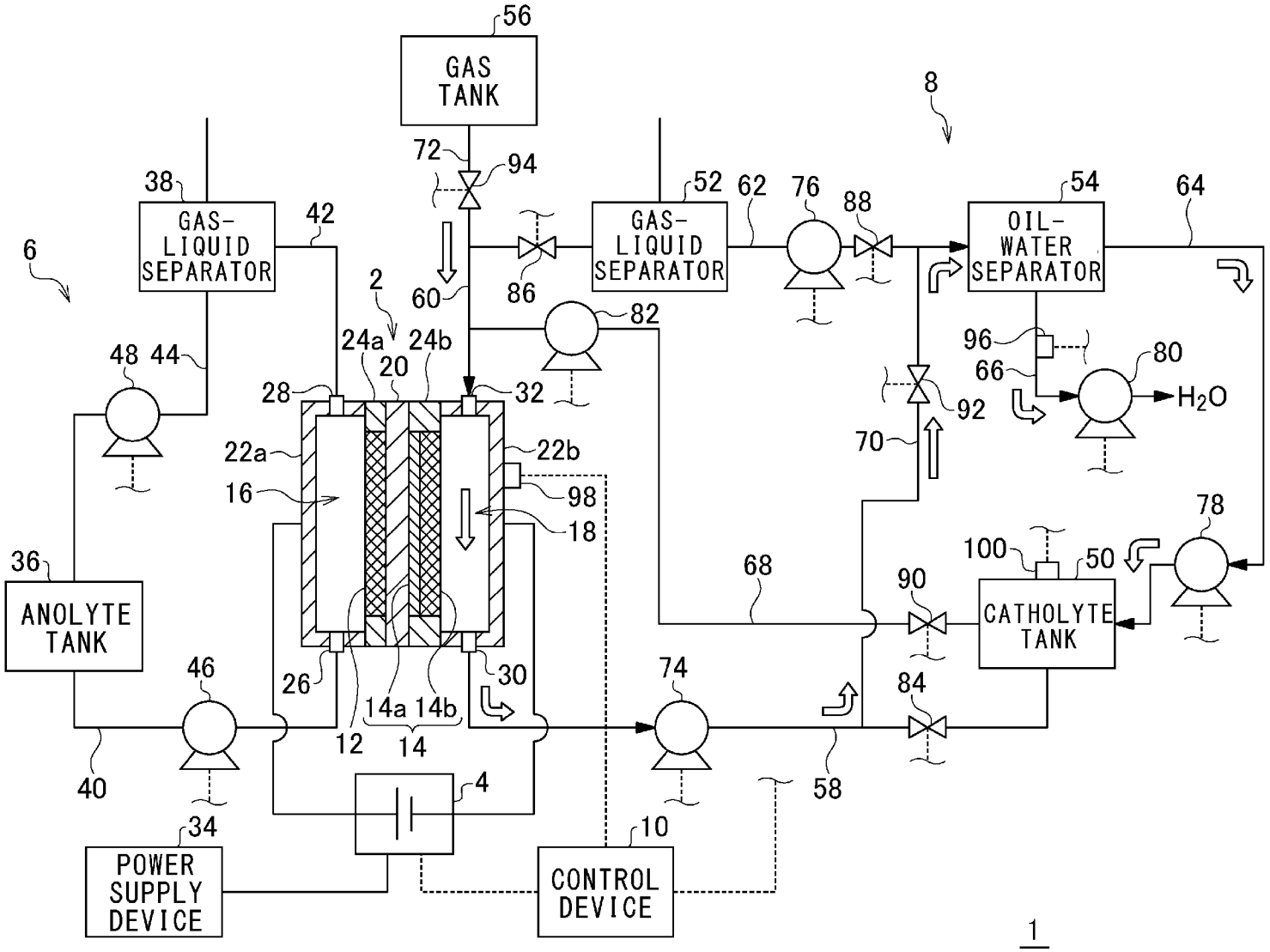
FIG. 3 is a schematic view showing a third path of a catholyte.

In FIGS. 1 to 3, each cathode opening extends linearly. Therefore, an outer end of the first cathode opening 30, that is, an opening connected to the outside of the system of the electrolytic bath 2 is also disposed below an outer end of the second cathode opening 32. However, the position of the outer end of each cathode opening is not particularly limited. For example, the outer end of the second cathode opening 32 may be at the same height position as the outer end of the first cathode opening 30 by the second cathode opening 32 being routed downward outside the cathode chamber 18 (for example, inside the plate material forming the end plate 22*b*).

The anode chamber 16 and the cathode chamber 18 are partitioned by the diaphragm 20. The diaphragm 20 is sandwiched between the anode electrode 12 and the cathode electrode 14. The diaphragm 20 of the present embodiment includes a solid polymer electrolyte membrane having proton conductivity, and transfers protons from the side of the anode chamber 16 to the side of the cathode chamber 18. The solid polymer electrolyte membrane is not particularly limited as long as it is a material through which protons conduct, and examples thereof include a fluorine-based ion exchange membrane having a sulfonate group.

The anolyte is supplied to the anode chamber 16 by the anolyte supply device 6. The anolyte contains water to be supplied to the anode electrode 12. Examples of the anolyte include an aqueous sulfuric acid solution, an aqueous nitric acid solution, an aqueous hydrochloric acid solution, pure water, and ion-exchanged water.

The catholyte is supplied to the cathode chamber 18 by the catholyte supply device 8. The catholyte contains an organic hydride raw material (substance to be hydrogenated) to be supplied to the cathode electrode 14. As an example, the catholyte does not contain an organic hydride before the start of the operation of the organic hydride production system 1, and after the start of the operation, the organic hydride generated by electrolysis is mixed in, whereby the catholyte becomes the liquid mixture of the substance to be hydrogenated and the organic hydride. The substance to be hydrogenated and the organic hydride are preferably a liquid at 20° C. and 1 atm.

The substance to be hydrogenated and the organic hydride used in the present embodiment are not particularly limited as long as they are organic compounds to or from which hydrogen can be added/removed by reversibly causing a hydrogenation reaction/dehydrogenation reaction, and an acetone-isopropanol type, a benzoquinone-hydroquinone type, an aromatic hydrocarbon type, or the like can be widely used. Among these, the aromatic hydrocarbon type is preferable from the viewpoint of transportability during energy transport or the like.

An aromatic hydrocarbon compound used as the substance to be hydrogenated is a compound containing at least one aromatic ring, and examples thereof include benzene, alkylbenzene, naphthalene, alkylnaphthalene, anthracene, and diphenylethane. The alkylbenzene contains a compound in which 1 to 4 hydrogen atoms of an aromatic ring are substituted with a linear alkyl group or a branched alkyl group having 1 to 6 carbons, and examples of such a compound include toluene, xylene, mesitylene, ethylbenzene, and diethylbenzene. The alkylnaphthalene contains a compound in which 1 to 4 hydrogen atoms in the aromatic ring are substituted with a linear alkyl group or a branched alkyl group having 1 to 6 carbon atoms. Examples of such a compound include methylnaphthalene. These compounds may be used alone or in combination.

The substance to be hydrogenated is preferably at least one of toluene and benzene. It is also possible to use a nitrogen-containing heterocyclic aromatic compound such as pyridine, pyrimidine, pyrazine, quinoline, isoquinoline, N-alkylpyrrole, N-alkylindole, or N-alkyldibenzopyrrole as the substance to be hydrogenated. The organic hydride is obtained by hydrogenating the above-described substance to be hydrogenated, and examples thereof include cyclohexane, methylcyclohexane, dimethylcyclohexane, and piperidine.

Although only one electrolytic bath 2 is illustrated in FIG. 1, the organic hydride production system 1 may have a plurality of electrolytic baths 2. In this case, the respective electrolytic baths 2 are arranged in the same direction such that the anode chamber 16 and the cathode chamber 18 are arranged in the same direction, and are stacked with an electric conduction plate interposed between the adjacent electrolytic baths 2. As a result, the electrolytic baths 2 are electrically connected in series. The electric conduction plate includes a conductive material such as a metal. Note that the electrolytic baths 2 may be connected in parallel, or may be a combination of series connection and parallel connection.

A reaction that occurs in a case where toluene (TL) is used as an example of the substance to be hydrogenated in the electrolytic bath 2 is as follows. The organic hydride obtained in a case where toluene is used as the substance to be hydrogenated is methylcyclohexane (MCH).

<Electrode Reaction in Anode Electrode>

$$3H_2O \rightarrow 3/2O_2 + 6H^+ + 6e^-$$

<Electrode Reaction in Cathode Electrode>

$$TL + 6H^+ + 6e^- \rightarrow MCH$$

That is, the electrode reaction in the anode electrode 12 and the electrode reaction in the cathode electrode 14 proceed in parallel. The protons generated by electrolysis of water in the anode electrode 12 are supplied to the cathode electrode 14 through the diaphragm 20. In addition, the electrons generated by the electrolysis of water are supplied to the cathode electrode 14 through the end plate 22*a*, an external circuit, and the end plate 22*b*. The protons and electrons supplied to the cathode electrode 14 are used for the hydrogenation of toluene in the cathode electrode 14. As a result, methylcyclohexane is generated.

Therefore, according to the organic hydride production system 1 according to the present embodiment, the electrolysis of water and the hydrogenation reaction of the substance to be hydrogenated can be performed in one step. For this reason, organic hydride production efficiency can be increased as compared with a conventional technique in which the organic hydride is produced by a two-step process which includes a process of producing hydrogen by water electrolysis or the like and a process of chemically hydrogenating the substance to be hydrogenated in a reactor such as a plant. Furthermore, since the reactor for performing the chemical hydrogenation and a high-pressure vessel for storing the hydrogen produced by the water electrolysis or the like are not required, a significant reduction in facility cost can be achieved.

In the cathode electrode 14, the following hydrogen gas generation reaction may occur as a side reaction together with the hydrogenation reaction of the substance to be hydrogenated which is the main reaction. As the supply amount of the substance to be hydrogenated to the catalyst layer 14*a* becomes insufficient, this side reaction is more likely to occur.

<Side Reaction that can Occur in Cathode Electrode>

$$2H^{+}+2e^{-}\rightarrow H_2$$

When the protons move from the side of the anode chamber 16 to the side of the cathode chamber 18 through the diaphragm 20, the protons move together with water molecules. Therefore, water is accumulated in the catalyst layer 14*a* as the electrolytic reduction reaction proceeds.

The power supply 4 is a DC power supply that supplies power to the electrolytic bath 2. When power is supplied from the power supply 4 to the electrolytic bath 2, a predetermined electrolytic voltage is applied between the anode electrode 12 and the cathode electrode 14 of the electrolytic bath 2, and an electrolytic current flows. The power supply 4 receives power supplied from a power supply device 34 and supplies power to the electrolytic bath 2. The power supply device 34 can include a power generation device that generates power using renewable energy, for example, a wind power generation device, a solar power generation device, or the like. Note that the power supply device 34 is not limited to the power generation device using renewable energy, and may be a system power supply, a power storage device storing power from the power generation device using renewable energy or the system power supply, or the like. In addition, a combination of two or more of them may be used.

The anolyte supply device 6 supplies the anolyte to the anode chamber 16. The anolyte supply device 6 has an anolyte tank 36, a gas-liquid separator 38, a first anode pipe 40, a second anode pipe 42, a third anode pipe 44, a first anode pump 46, and a second anode pump 48. The gas-liquid separator 38 can include a known gas-liquid separation tank. The first anode pump 46 and the second anode pump 48 can include known pumps such as a gear pump and a cylinder pump. Note that the anolyte supply device 6 may circulate the anolyte using a liquid feeding device other than the pump.

The anolyte tank 36 stores the anolyte to be supplied to the anode chamber 16. The anolyte tank 36 is connected to the anode chamber 16 by the first anode pipe 40. The first anode pipe 40 has one end connected to the anolyte tank 36 and the other end connected to the first anode opening 26. The first anode pump 46 is provided in the middle of the first anode pipe 40. The gas-liquid separator 38 is connected to the anode chamber 16 by the second anode pipe 42. The second anode pipe 42 has one end connected to the second anode opening 28 and the other end connected to the gas-liquid separator 38. The gas-liquid separator 38 is connected to the anolyte tank 36 by the third anode pipe 44. The second anode pump 48 is provided in the middle of the third anode pipe 44.

The anolyte in the anolyte tank 36 flows into the anode chamber 16 from the first anode opening 26 through the first anode pipe 40 by driving of the first anode pump 46. The anolyte is supplied to the anode chamber 16 in an upflow and subjected to the electrode reaction in the anode electrode 12. The anolyte in the anode chamber 16 flows into the gas-liquid separator 38 through the second anode pipe 42. In the anode electrode 12, oxygen gas is generated by the electrode reaction. Therefore, the oxygen gas is mixed into the anolyte discharged from the anode chamber 16. The gas-liquid separator 38 separates the oxygen gas in the anolyte from the anolyte and discharges the oxygen gas to the outside of the system. The anolyte from which the oxygen gas has been separated is returned to the anolyte tank 36 through the third anode pipe 44 by driving of the second anode pump 48.

The catholyte supply device 8 supplies the catholyte to the cathode chamber 18. The catholyte supply device 8 has a catholyte tank 50, a gas-liquid separator 52, an oil-water separator 54, a gas tank 56, a first cathode pipe 58 to an eighth cathode pipe 72, a first cathode pump 74 to a fifth cathode pump 82, and a first on-off valve 84 to a sixth on-off valve 94. The gas-liquid separator 52 can include a known gas-liquid separation tank. The oil-water separator 54 can include a known oil-water separation tank. The first cathode pump 74 to the fifth cathode pump 82 can include known pumps such as a gear pump and a cylinder pump. Note that the catholyte supply device 8 may circulate the catholyte using a liquid feeding device other than the pump. The first on-off valve 84 to the sixth on-off valve 94 can include known valves such as electromagnetic valves and air drive valves.

The catholyte tank 50 stores the catholyte to be supplied to the cathode chamber 18. The catholyte tank 50 is connected to the cathode chamber 18 by the first cathode pipe 58. The first cathode pipe 58 has one end connected to the catholyte tank 50 and the other end connected to the first cathode opening 30. The first cathode pump 74 and the first on-off valve 84 are provided in the middle of the first cathode pipe 58. The first cathode pump 74 is disposed closer to the cathode chamber 18 than the first on-off valve 84. The gas-liquid separator 52 is connected to the cathode chamber 18 by the second cathode pipe 60. The second cathode pipe 60 has one end connected to the second cathode opening 32 and the other end connected to the gas-liquid separator 52. The second on-off valve 86 is provided in the middle of the second cathode pipe 60.

The oil-water separator 54 is connected to the gas-liquid separator 52 by the third cathode pipe 62. The second cathode pump 76 and the third on-off valve 88 are provided in the middle of the third cathode pipe 62. The second cathode pump 76 is disposed closer to the gas-liquid separator 52 than the third on-off valve 88. The oil-water separator 54 is connected to the catholyte tank 50 by the fourth cathode pipe 64. The third cathode pump 78 is provided in the middle of the fourth cathode pipe 64. Further, the fifth cathode pipe 66 is connected to the oil-water separator 54. The fifth cathode pipe 66 has one end connected to the oil-water separator 54 and the other end connected to, for example, a drainage tank (not shown in the drawings). The fourth cathode pump 80 and a water amount sensor 96 are provided in the middle of the fifth cathode pipe 66. The water amount sensor 96 detects a flow rate of water flowing through the fifth cathode pipe 66. The water amount sensor 96 can include a known flowmeter.

The catholyte tank 50 is also connected to the cathode chamber 18 by the sixth cathode pipe 68. The sixth cathode pipe 68 has one end connected to the catholyte tank 50 and the other end connected to the second cathode opening 32 via the second cathode pipe 60. The fifth cathode pump 82 and the fourth on-off valve 90 are provided in the middle of the sixth cathode pipe 68. The fifth cathode pump 82 is disposed closer to the cathode chamber 18 than the fourth on-off valve 90. In the present embodiment, the other end of the sixth cathode pipe 68 is connected to a region of the second cathode pipe 60 closer to the cathode chamber 18 than the second on-off valve 86, thereby being connected to the second cathode opening 32 via the second cathode pipe 60. However, the present invention is not limited to this configuration, and the sixth cathode pipe 68 may be directly connected to the second cathode opening 32.

The oil-water separator 54 is connected to the cathode chamber 18 by the seventh cathode pipe 70. The seventh cathode pipe 70 has one end connected to the first cathode opening 30 via the first cathode pipe 58 and the other end connected to the oil-water separator 54 via the third cathode pipe 62. The fifth on-off valve 92 is provided in the middle of the seventh cathode pipe 70. In the present embodiment, one end of the seventh cathode pipe 70 is connected to a region of the first cathode pipe 58 closer to the cathode chamber 18 than the first on-off valve 84, thereby being connected to the first cathode opening 30 via the first cathode pipe 58. However, the present invention is not limited to this configuration, and the seventh cathode pipe 70 may be directly connected to the first cathode opening 30. The other end of the seventh cathode pipe 70 is connected to a region of the third cathode pipe 62 closer to the oil-water separator 54 than the third on-off valve 88, thereby being connected to the oil-water separator 54 via the third cathode pipe 62. However, the present invention is not limited to this configuration, and the seventh cathode pipe 70 may be directly connected to the oil-water separator 54.

The gas tank 56 is connected to the cathode chamber 18 by the eighth cathode pipe 72. The eighth cathode pipe 72 has one end connected to the gas tank 56 and the other end connected to the second cathode opening 32 via the second cathode pipe 60. The sixth on-off valve 94 is provided in the middle of the eighth cathode pipe 72. In the present embodiment, the other end of the eighth cathode pipe 72 is connected to a region of the second cathode pipe 60 closer to the cathode chamber 18 than the second on-off valve 86, thereby being connected to the second cathode opening 32 via the second cathode pipe 60. However, the present invention is not limited to this configuration, and the eighth cathode pipe 72 may be directly connected to the second cathode opening 32.

As shown in FIG. 1, the catholyte supply device 8 can form the first path of the catholyte by the catholyte tank 50, the first cathode pipe 58, the cathode chamber 18, the second cathode pipe 60, the gas-liquid separator 52, the third cathode pipe 62, the oil-water separator 54, and the fourth cathode pipe 64. In the first path, an upflow of the catholyte is formed in the cathode chamber 18. The "upflow" of the catholyte in the present disclosure refers to allowing the catholyte to flow into the cathode chamber 18 from the lower first cathode opening 30 and discharging the catholyte from the upper second cathode opening 32.

Specifically, the catholyte in the catholyte tank 50 flows into the cathode chamber 18 from the first cathode opening 30 through the first cathode pipe 58 by driving of the first cathode pump 74. The first on-off valve 84 is opened to allow the circulation of the catholyte from the catholyte tank 50 to the first cathode opening 30. The fifth on-off valve 92 is closed to block the circulation of the catholyte from the catholyte tank 50 to the oil-water separator 54. The catholyte is supplied to the cathode chamber 18 in an upflow.

The catholyte in the cathode chamber 18 flows into the gas-liquid separator 52 through the second cathode pipe 60. The second on-off valve 86 is opened to allow the circulation of the catholyte from the second cathode opening 32 to the gas-liquid separator 52. The fourth on-off valve 90 is closed to block the circulation of the catholyte from the second cathode opening 32 to the catholyte tank 50. The sixth on-off valve 94 is closed to block the circulation of the catholyte from the second cathode opening 32 to the gas tank 56. As described above, hydrogen gas is generated by the side reaction in the cathode electrode 14. Therefore, the hydrogen gas is mixed in the catholyte discharged from the cathode chamber 18. The gas-liquid separator 52 separates the hydrogen gas in the catholyte from the catholyte and discharges the hydrogen gas to the outside of the system.

The catholyte from which the hydrogen gas has been separated flows into the oil-water separator 54 through the third cathode pipe 62 by driving of the second cathode pump 76. The third on-off valve 88 is opened to allow the circulation of the catholyte from the gas-liquid separator 52 to the oil-water separator 54. The fifth on-off valve 92 is closed to block the circulation of the catholyte from the gas-liquid separator 52 to the catholyte tank 50 and the cathode chamber 18.

As described above, water moves from the anode electrode 12 to the cathode electrode 14 together with protons. Therefore, the water is mixed in the catholyte discharged from the cathode chamber 18. The oil-water separator 54 separates the water in the catholyte from the catholyte. The separated water is discharged to the drainage tank through the fifth cathode pipe 66 by driving of the fourth cathode pump 80. The amount of water separated from the catholyte by the oil-water separator 54, in other words, the amount of water discharged from the cathode chamber 18 is detected by the water amount sensor 96. The catholyte from which the water has been separated is returned to the catholyte tank 50 through the fourth cathode pipe 64 by driving of the third cathode pump 78.

FIG. 2 is a schematic view showing a second path of the catholyte. As shown in FIG. 2, the catholyte supply device 8 can form the second path of the catholyte by the catholyte tank 50, the sixth cathode pipe 68, the second cathode pipe 60, the cathode chamber 18, the first cathode pipe 58, the seventh cathode pipe 70, the third cathode pipe 62, the oil-water separator 54, and the fourth cathode pipe 64. In the second path, a downflow of the catholyte is formed in the cathode chamber 18. The "downflow" of the catholyte in the present disclosure refers to allowing the catholyte to flow into the cathode chamber 18 from the upper second cathode opening 32 and discharging the catholyte from the lower first cathode opening 30.

Specifically, the catholyte in the catholyte tank 50 flows into the cathode chamber 18 from the second cathode opening 32 through the sixth cathode pipe 68 and the second cathode pipe 60 by driving of the fifth cathode pump 82. The fourth on-off valve 90 is opened to allow the circulation of the catholyte from the catholyte tank 50 to the second cathode opening 32. The second on-off valve 86 is closed to block the circulation of the catholyte from the catholyte tank 50 to the gas-liquid separator 52. The sixth on-off valve 94 is closed to block the circulation of the catholyte from the catholyte tank 50 to the gas tank 56. The catholyte is supplied to the cathode chamber 18 in a downflow.

The catholyte in the cathode chamber 18 flows into the oil-water separator 54 through the first cathode pipe 58, the seventh cathode pipe 70, and the third cathode pipe 62. The fifth on-off valve 92 is opened to allow the circulation of the catholyte from the first cathode opening 30 to the oil-water separator 54. The first on-off valve 84 is closed to block the circulation of the catholyte from the first cathode opening 30 to the catholyte tank 50. The third on-off valve 88 is closed to block the circulation of the catholyte from the first cathode opening 30 to the gas-liquid separator 52.

The oil-water separator 54 separates the water in the catholyte from the catholyte. The separated water is discharged to the drainage tank through the fifth cathode pipe 66 by driving of the fourth cathode pump 80. The amount of separated water is detected by the water amount sensor 96. The catholyte from which the water has been separated is returned to the catholyte tank 50 through the fourth cathode pipe 64 by driving of the third cathode pump 78. Note that the catholyte tank 50 may also have the function of the oil-water separator 54.

FIG. 3 is a schematic view showing a third path of the catholyte. As shown in FIG. 3, the catholyte supply device 8 can form the third path of the catholyte by the gas tank 56, the eighth cathode pipe 72, the second cathode pipe 60, the cathode chamber 18, the first cathode pipe 58, the seventh cathode pipe 70, the third cathode pipe 62, the oil-water separator 54, the fourth cathode pipe 64, and the catholyte tank 50.

Specifically, the sixth on-off valve 94 is opened, so that the predetermined gas filled into the gas tank 56 flows into the cathode chamber 18 from the second cathode opening 32 through the eighth cathode pipe 72 and the second cathode pipe 60. The second on-off valve 86 is closed to block the circulation of the gas from the gas tank 56 to the gas-liquid separator 52. Examples of the gas filled into the gas tank 56 include inert gas such as nitrogen gas, and hydrogen gas. As an example, the gas tank 56 is filled with gas at a high pressure. Therefore, when the sixth on-off valve 94 is opened, the gas in the gas tank 56 automatically flows into the cathode chamber 18. Note that the filling pressure of the gas into the gas tank 56 may not be a negative pressure with respect to the pressure outside the gas tank 56. For example, as long as the gas tank 56 is disposed above and the cathode chamber 18, the oil-water separator 54, and the catholyte tank 50 are disposed below in this order, the gas tank 56 may be filled with the gas at a normal pressure.

When the gas flows into the cathode chamber 18, the catholyte in the cathode chamber 18 is pushed out of the cathode chamber 18, and flows into the oil-water separator 54 through the first cathode pipe 58, the seventh cathode pipe 70, and the third cathode pipe 62. The fifth on-off valve 92 is opened to allow the circulation of the catholyte from the first cathode opening 30 to the oil-water separator 54. The first on-off valve 84 is closed to block the circulation of the catholyte from the first cathode opening 30 to the catholyte tank 50. The third on-off valve 88 is closed to block the circulation of the catholyte from the first cathode opening 30 to the gas-liquid separator 52.

The oil-water separator 54 separates the water in the catholyte from the catholyte. The separated water is discharged to the drainage tank through the fifth cathode pipe 66 by driving of the fourth cathode pump 80. The amount of separated water is detected by the water amount sensor 96. The catholyte from which the water has been separated is returned to the catholyte tank 50 through the fourth cathode pipe 64 by driving of the third cathode pump 78.

The first cathode pipe 58 corresponds to a first pipe connecting the catholyte tank 50 and the cathode chamber 18 in the present disclosure. The second cathode pipe 60 and the sixth cathode pipe 68 correspond to a second pipe connecting the catholyte tank 50 and the cathode chamber 18 in the present disclosure. The first cathode pump 74 corresponds to a supply device that supplies the catholyte from the catholyte tank 50 to the cathode chamber 18 through the first cathode pipe 58 that is the first pipe in the present disclosure. The fifth cathode pump 82 corresponds to a supply device that supplies the catholyte from the catholyte tank 50 to the cathode chamber 18 through the sixth cathode pipe 68 and the second cathode pipe 60 that are the second pipe. The gas tank 56 and the sixth on-off valve 94 correspond to a gas supply mechanism that supplies the predetermined gas to the cathode chamber 18 in the present disclosure.

The control device 10 controls the supply of power from the power supply 4 to the electrolytic bath 2. The potentials of the anode electrode 12 and the cathode electrode 14 are controlled by the control device 10. The control device 10 is realized by an element or a circuit such as a CPU or a memory of a computer as a hardware configuration, and is realized by a computer program or the like as a software configuration. However, the control device 10 is illustrated as functional blocks realized by cooperation between them in FIGS. 1 to 3. It should be understood by those skilled in the art that the functional blocks can be implemented in various forms by a combination of hardware and software.

At least one of a signal indicating a voltage of the electrolytic bath 2, a signal indicating a potential of the anode electrode 12, and a signal indicating a potential of the cathode electrode 14 is input to the control device 10 from a detector 98 provided in the electrolytic bath 2. The detector 98 can detect the potential of each electrode and the voltage of the electrolytic bath 2 by a known method. The detector 98 has, for example, a known voltmeter.

When the detector 98 detects the potential of the anode electrode 12 or the potential of the cathode electrode 14, a reference electrode is provided in the diaphragm 20. The reference electrode is held at the reference electrode potential. The reference electrode is, for example, a reversible hydrogen electrode (RHE). The detector 98 has one terminal connected to the reference electrode and the other terminal connected to an electrode to be detected, and the potential of the electrode with respect to the reference electrode is detected. In addition, when the detector 98 detects the voltage of the electrolytic bath 2, one terminal of the detector 98 is connected to the anode electrode 12 and the other terminal thereof is connected to the cathode electrode 14, and a potential difference between both the electrodes, that is, the voltage is detected. The detector 98 transmits a signal indicating a detection result to the control device 10.

The detector 98 includes a current detector that detects a current flowing between the anode electrode 12 and the cathode electrode 14. The current detector includes, for example, a known ammeter. A current value detected by the current detector is input to the control device 10. The control device 10 may hold information of current-voltage characteristics (I-V characteristics) of the electrolytic bath 2 in advance. In a case where the control device 10 holds the information of the I-V characteristics, the information may be arbitrarily updatable. The I-V characteristics of the electrolytic bath 2 are characteristics determined according to the catalyst composition of each electrode, the types of the diffusion layer and the base material, the type of the diaphragm 20, the flow path structures of the anolyte and catholyte of the electrolytic bath 2, the dimensions of the respective parts, and the like, and can be measured and grasped in advance. In this case, the control device 10 can grasp the amount of power that can be supplied from the power supply 4 to the electrolytic bath 2 by receiving the signal indicating the amount of power supplied from the power supply device 34, and calculate a value of the voltage to be applied to the electrolytic bath 2 from the I-V characteristics, that is, can control a value of the current flowing through the electrolytic bath 2.

The control device 10 controls the anolyte supply device 6 and the catholyte supply device 8. Specifically, the control device 10 controls driving of the first anode pump 46, the second anode pump 48, and the first cathode pump 74 to the fifth cathode pump 82. In addition, the control device 10 controls opening and closing of the first on-off valve 84 to the sixth on-off valve 94. In addition, the control device 10 receives a signal indicating a detection result from the water amount sensor 96.

As described above, in the cathode electrode 14, the hydrogenation reaction of the substance to be hydrogenated may occur as the main reaction, and the hydrogen generation reaction may occur as the side reaction. The occurrence of the side reaction leads to reduction in the Faraday efficiency of the organic hydride production system 1. In addition, since protons move from the side of the anode electrode 12 to the side of the cathode electrode 14 with water, the water is accumulated in the cathode chamber 18. The water inhibits the flow of the substance to be hydrogenated. Therefore, when a large amount of water is accumulated in the cathode chamber 18, the amount of the substance to be hydrogenated supplied to the reaction field of the catalyst layer 14*a* decreases, and the side reaction is more likely to proceed. The hydrogen gas generated by the side reaction also inhibits the flow of the substance to be hydrogenated. For this reason, the side reaction is more likely to occur by the hydrogen gas generated by the side reaction. Therefore, it is desirable to discharge the hydrogen gas and the water staying in the cathode chamber 18 from the cathode chamber 18.

The hydrogen gas has a specific gravity smaller than that of the substance to be hydrogenated or the organic hydride. On the other hand, the water has a specific gravity larger than that of the substance to be hydrogenated or the organic hydride. Therefore, when the upflow of the catholyte is formed in the cathode chamber 18, the hydrogen gas is easily discharged from the cathode chamber 18, but the water is hardly discharged from the cathode chamber 18 and accumulated in the bottom portion of the cathode chamber 18. Conversely, when the downflow is formed in the cathode chamber 18, the water is easily discharged from the cathode chamber 18, but the hydrogen gas is hardly discharged from the cathode chamber 18 and accumulated in the upper portion of the cathode chamber 18.

When the hydrogen gas is accumulated in the cathode chamber 18, it is difficult for the catholyte to uniformly spread over the entire surface of the cathode electrode 14. In addition, the internal pressure of the cathode chamber 18 may increase to cause leakage of the catholyte. For this reason, in the conventional organic hydride production system, the catholyte is always supplied to the cathode chamber 18 in the upflow by focusing on the discharge of the hydrogen gas. Sufficient measures are not taken against the water accumulated in the cathode chamber 18.

However, in order to improve the Faraday efficiency of the organic hydride production system, the water accumulated in the cathode chamber 18 is a problem that cannot be ignored. On the other hand, the control device 10 of the present embodiment controls the catholyte supply device 8 to supply the catholyte from the first cathode opening 30 to the cathode chamber 18 in a steady state to form the upflow of the catholyte in the cathode chamber 18. In addition, the control device 10 controls the catholyte supply device 8 to supply the catholyte from the second cathode opening 32 to the cathode chamber 18 under a predetermined condition to form the downflow of the catholyte in the cathode chamber 18.

That is, the control device 10 controls each cathode pump and each on-off valve so as to form the first path of the catholyte in a steady state. In the first path, the first cathode opening 30 serves as an inlet for the catholyte, the second cathode opening 32 serves as an outlet for the catholyte, and the upflow of the catholyte is formed in the cathode chamber 18. As a result, it is possible to promote the discharge of the hydrogen gas accumulated in the upper portion of the cathode chamber 18 and to suppress the occurrence of the side reaction. In addition, it is possible to suppress an excessive internal pressure of the cathode chamber 18.

In addition, the control device 10 controls each cathode pump and each on-off valve so as to temporarily form the second path of the catholyte. In the second path, the second cathode opening 32 serves as an inlet for the catholyte, the first cathode opening 30 serves as an outlet for the catholyte, and the downflow of the catholyte is formed in the cathode chamber 18. As a result, it is possible to promote the discharge of the water accumulated in the bottom portion of the cathode chamber 18 and to suppress the occurrence of the side reaction.

In particular, when the solubility of the substance to be hydrogenated and the organic hydride in the water is lower, it is more effective to discharge the water by the formation of the downflow. For example, when the solubility of at least one of the substance to be hydrogenated and the organic hydride in the water is preferably 3 g/100 mL or less, and more preferably 2 g/100 mL or less, the water discharge by the downflow is more effective. Examples of the substance to be hydrogenated and the organic hydride expected to have the effect of drainage by the downflow include benzene (0.18 g/100 mL $H_2O$) and cyclohexane (0.36 g/100 mL $H_2O$); toluene (0.05 g/100 mL $H_2O$) and methylcyclohexane (1.6 g/100 mL $H_2O$); or naphthalene (0.003 g/100 mL $H_2O$) and decahydronaphthalene (0.001 g/100 mL $H_2O$).

In the present embodiment, the steady state means a state in which the electrolytic bath 2 does not satisfy predetermined condition described below. The steady state as an example means that the organic hydride production system 1 is in operation. The in-operation means a state in which a positive current that causes electrolysis in the electrolytic bath 2, that is, an electrolytic current flows. During the operation of the organic hydride production system 1, the side reaction may occur due to a change in the concentration of the substance to be hydrogenated in the catholyte or a change in the magnitude of the electrolytic current flowing through the electrolytic bath 2. Therefore, the upflow of the catholyte is formed in the cathode chamber 18 in the steady state.

On the other hand, in a situation where the possibility that the side reaction occurs is lower than that in the steady state, it is possible to prioritize the discharge of water over the discharge of hydrogen gas. Therefore, in the present embodiment, it is defined as a predetermined condition that the possibility of occurrence of the side reaction is lower than that in the steady state, and when this predetermined condition is satisfied, the upflow of the catholyte is switched to the downflow. As a result, it is possible to suppress the occurrence of the side reaction caused by the water while avoiding an increase in the internal pressure of the cathode chamber 18.

In the present embodiment, the predetermined condition includes operation stop of the electrolytic bath 2. The operation stop means a state in which no electrolytic current flows to the electrolytic bath 2. When the operation of the electrolytic bath 2 is stopped, the possibility that the hydrogen gas is generated is naturally lower than that during the operation of the electrolytic bath 2. The control device 10 can determine whether or not the electrolytic bath 2 is in operation, in other words, whether or not the electrolytic current flows to the electrolytic bath 2, based on a signal sent from the detector 98 or the power supply 4. When the operation stop of the electrolytic bath 2 is detected, the control device 10 determines that the predetermined condition has been satisfied and switches the path from the first path to the second path.

Figure 4:
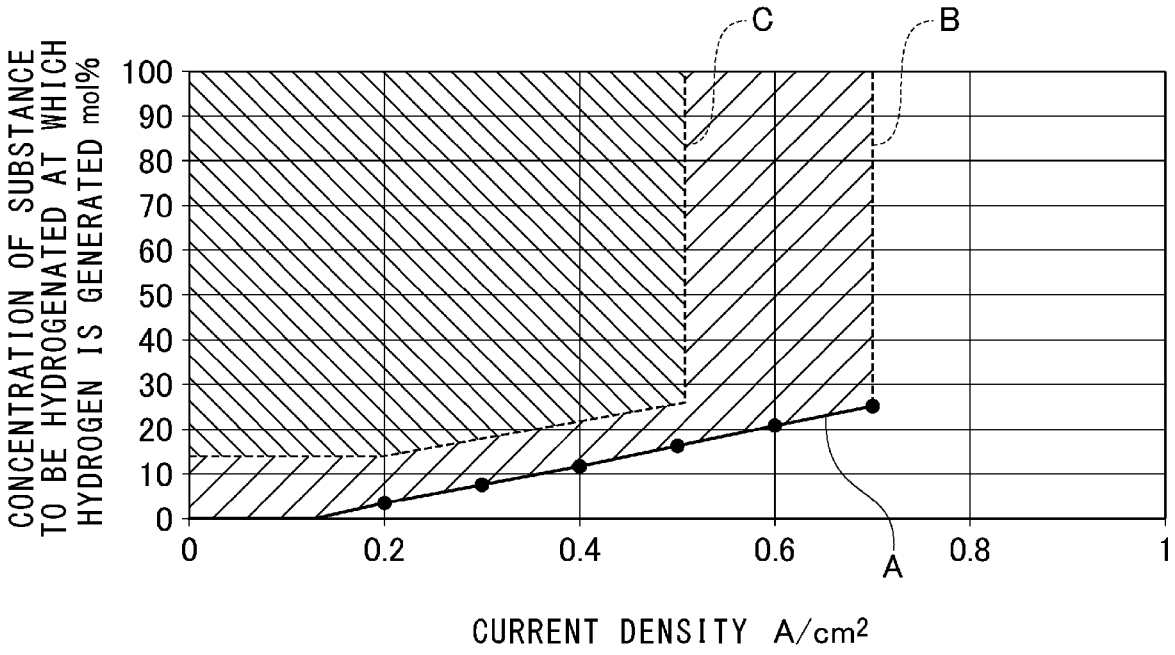
FIG. 4 is a diagram showing a relation between a current density in an electrolytic bath and a concentration of a substance to be hydrogenated at which hydrogen gas is generated.

The predetermined condition includes a state in which the amount of hydrogen gas generated during the operation of the electrolytic bath 2 is a predetermined value or less, which is derived from a relation between the current (for example, the current density) flowing through the electrolytic bath 2 and the concentration of the substance to be hydrogenated in the catholyte. FIG. 4 is a diagram showing the relation between the current density in the electrolytic bath 2 and the concentration of the substance to be hydrogenated at which the hydrogen gas is generated.

When the concentration of the substance to be hydrogenated in the catholyte is sufficiently high at a certain current density, the substance to be hydrogenated is mainly hydrogenated, and the generation of hydrogen gas is suppressed. On the other hand, when the concentration of the substance to be hydrogenated decreases to a predetermined value even at the same current density, the substance to be hydrogenated is insufficient and the side reaction occurs, and the hydrogen gas starts to be generated. When the electrolytic current in the electrolytic bath 2 is small at a certain concentration of the substance to be hydrogenated, the electrode reaction hardly proceeds, so that a consumption amount of the substance to be hydrogenated is reduced. Therefore, a shortage of the substance to be hydrogenated does not occur, and generation of the hydrogen gas is suppressed. On the other hand, when the current density is large even at the same concentration of the substance to be hydrogenated, the electrolytic reaction easily proceeds, so that the consumption amount of the substance to be hydrogenated increases. For this reason, the substance to be hydrogenated is insufficient, the side reaction occurs, and the hydrogen gas starts to be generated.

Therefore, even in a case where the electrolytic bath 2 is in operation, when the current density is the predetermined value or less and the concentration of the substance to be hydrogenated is the predetermined value or more, the control device 10 determines that the predetermined condition has been satisfied and switches the path from the first path to the second path, because it is estimated that the generation amount or the possibility of the generation of hydrogen gas is low as compared with that in the steady state. Regarding a range of the current density and the concentration of the substance to be hydrogenated satisfying the condition, a measurement line A illustrated in FIG. 4 is obtained from the concentration of the substance to be hydrogenated (measurement point) at which hydrogen gas starts to be generated at each current density when the substance to be hydrogenated is toluene. For example, when the current density is 0.7 A/cm$^2$, the hydrogen gas starts to be generated in a case where the concentration of the substance to be hydrogenated of the catholyte is 27 mol %.

The measurement line A can be obtained by, for example, the following test. That is, constant current electrolysis (preliminary operation) is performed at a current density of 0.2 A/cm$^2$ for 10 minutes using a predetermined electrolytic bath. During the electrolysis, the entire electrolytic bath is kept at 60° C. A 1M sulfuric acid aqueous solution is circulated in the anode chamber at a flow rate of 20 mL/min. The catholyte is circulated from a storage to the cathode chamber at a flow rate of 20 mL/min. The catholyte is 0.5 mol of 100 mol % toluene. After the preliminary operation, the current density is increased to 0.7 A/cm$^2$ to start constant current electrolysis. Conditions other than the current density are the same as those in the preliminary operation. After the start of electrolysis, when air bubbles (hydrogen gas generated by the side reaction) are confirmed at the outlet of the electrolytic bath, the current density is decreased by 0.05 A/cm$^2$ to become 0.65 A/cm$^2$. In addition, the catholyte is sampled together with the adjustment of the current density, and the concentrations of toluene and methylcyclohexane are measured by gas chromatography. Then, the concentration of toluene when air bubbles are visually confirmed is defined as the concentration at which the hydrogen gas is generated at the current density. The constant current electrolysis at a current density of 0.65 A/cm$^2$ is continued and the current density is decreased by 0.05 A/cm$^2$ when air bubbles are confirmed at the outlet of the electrolytic bath. The catholyte is sampled and the concentrations of toluene and methylcyclohexane are measured. By repeating this measurement work at a current density of 0.2 A/cm$^2$ until air bubbles are confirmed, the measurement line A is obtained. In FIG. 4, a maximum value of the current density is 0.7 A/cm$^2$, but this is due to the restriction of an evaluation device, and the upper limit of the current density is not intended to be limited to 0.7 A/cm$^2$.

Therefore, in FIG. 4, in a first range B where the concentration of the substance to be hydrogenated is above the measurement line A, theoretically, hydrogen gas is not generated. That is, the hydrogen gas generation amount is a predetermined value or less. The predetermined value is 0 in the present embodiment, but is not limited thereto, and can be appropriately set based on an experiment or a simulation. The relation between the current density and the concentration of the substance to be hydrogenated at which the hydrogen gas is generated, which is shown in FIG. 4, that is, information on the first range B is determined according to the catalyst composition of each electrode, the types of the diffusion layer and the base material, the type of the diaphragm 20, the flow path structures of the anolyte and catholyte in the electrolytic bath 2, the dimensions of the respective parts, and the like, and can be measured and grasped in advance. In the measurement, the fact that the hydrogen gas starts to be generated can be confirmed, for example, visually or by automatic detection by an optical analysis instrument or the like using a difference in refractive index between the liquid and the gas.

The upper limit of the current density and the lower limit of the concentration of the substance to be hydrogenated in the first range B can be appropriately set based on experiments or simulations as long as they are not below the measurement line A. In addition, a second range C in which the allowable ranges of the current density and the concentration of the substance to be hydrogenated are narrower than the first range B may be used as the path switching condition. The upper limit of the current density and the lower limit of the concentration of the substance to be hydrogenated in the second range C can also be appropriately set based on experiments or simulations.

The control device 10 receives a signal from a known concentration sensor 100 provided in the catholyte tank 50, for example, so that the concentration of the substance to be hydrogenated in the catholyte can be grasped. Note that the control device 10 can also calculate a production amount of organic hydride from a total amount of power supplied to the electrolytic bath 2 and calculate the concentration of the substance to be hydrogenated from a result thereof. In this case, the concentration sensor 100 can be omitted. In addition, the control device 10 can grasp the current density based on signals received from the detector 98, the power supply 4, or the power supply device 34. In addition, when the control device 10 detects that the current density of the electrolytic bath 2 and the concentration of the substance to be hydrogenated in the catholyte are included in the first range B or the second range C, the control device 10 determines that the predetermined condition has been satisfied and switches the path from the first path to the second path.

Note that the state described above in which the hydrogen gas generation amount is the predetermined value or less is established during the operation of the electrolytic bath 2. That is, "during operation" of the electrolytic bath 2 includes a state included in the first range B or the second range C (hereinafter, appropriately referred to as a low-load operation state) and a state not included in the first range B or the second range C (hereinafter, appropriately referred to as a high-load operation state). When the low-load operation state is included in the predetermined condition, the "steady state" means that the electrolytic bath 2 is in the high-load operation state.

When the power supply device 34 is a power generation device that generates power using renewable energy, the amount of power generation greatly varies depending on weather conditions. For example, in the case of a solar power generation device, the amount of power generation decreases when it is cloudy or after sunset. For this reason, the current density of the electrolytic bath 2 decreases, and the generation amount of hydrogen gas tends to be the predetermined value or less. By switching from the upflow to the downflow in such a state, it is possible to efficiently discharge the water accumulated in the cathode chamber 18 and improve the Faraday efficiency while suppressing a decrease in the operation rate of the organic hydride production system 1.

The predetermined condition under which the control device 10 switches the flow of the catholyte to the downflow may include a state in which the internal pressure of the cathode chamber 18 is a predetermined value or less or a state in which it is assumed that a rapid increase in the internal pressure does not occur. In addition, the predetermined condition may include a case where a tendency that the Faraday efficiency decreases is detected. The tendency that the Faraday efficiency decreases is, for example, a case where the Faraday efficiency which the electrolytic bath 2 originally exhibits is not obtained during the current operation. The Faraday efficiency that would be originally exhibited is derived based on, for example, statistical information of the Faraday efficiency during past operation. Further, the predetermined condition may include information such as a time, a weather forecast, and past power generation data, and prediction information of a power generation amount based on the information.

As an example, the control device 10 stops the downflow after a predetermined time elapses from switching to the downflow. The control device 10 has a built-in timer, and can detect that a predetermined time set in advance has elapsed. The predetermined time can be appropriately set based on an experiment or a simulation. For example, the predetermined time is a time at which the water in the cathode chamber 18 is estimated to be completely discharged, and is determined based on the volume of the cathode chamber 18, the flow rate of the catholyte, and the like.

As another example, the control device 10 stops the downflow when it is detected that the amount of water discharged from the cathode chamber 18 by the downflow has become a predetermined value or less based on the signal received from the water amount sensor 96. The predetermined value can be appropriately set based on an experiment or a simulation, and is, for example, 0.

When the electrolytic bath 2 is in operation when the downflow is stopped, the control device 10 switches the flow of the catholyte to the upflow. When the operation of the electrolytic bath 2 is stopped at the time of stopping the downflow, the control device 10 stops the circulation of the catholyte.

In addition, in a case of detecting the stop of the operation of the electrolytic bath 2 and switching the flow of the catholyte to the downflow, the control device 10 of the present embodiment controls the sixth on-off valve 94 as a gas supply mechanism so as to supply the gas in the gas tank 56 to the cathode chamber 18 after the downflow is stopped. That is, the control device 10 executes a gas purge process of the cathode chamber 18 by switching the path of the catholyte to the third path. As a result, the cathode chamber 18 is filled with the gas. By filling the cathode chamber 18 with the gas, the water in the cathode chamber 18 can be more reliably discharged. For example, after a lapse of a predetermined time from the start of gas supply, the control device 10 closes the sixth on-off valve 94 to stop gas release from the gas tank 56. The predetermined time can be appropriately set based on an experiment or a simulation. Note that switching from the first path to the third path, that is, switching from the upflow to execution of the gas purge process may be performed without passing through the second path. As an example of switching from the first path to the third path, there is a case where the operation is directly stopped from the high-load operation state.

Figure 5:
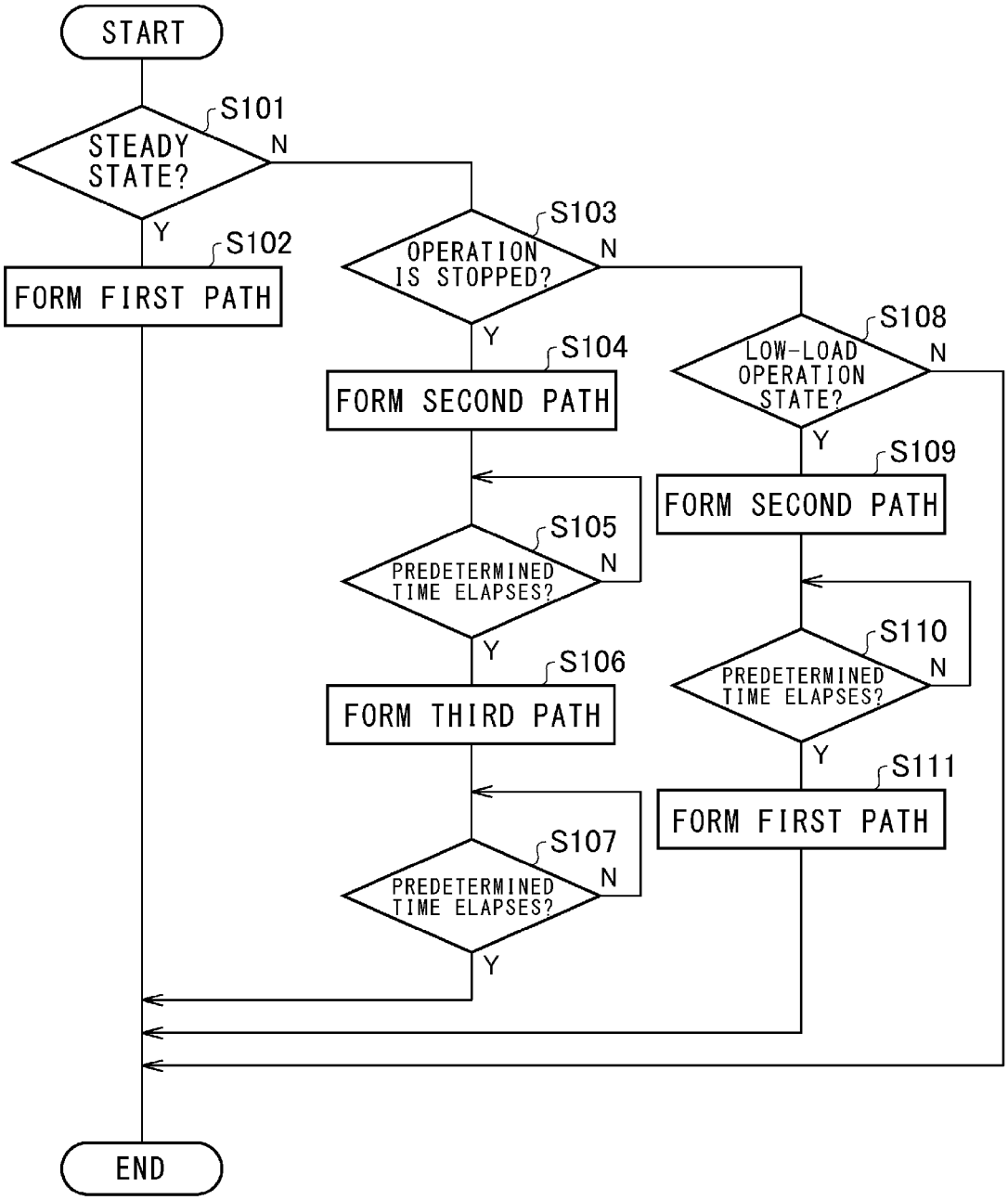
FIG. 5 is a flowchart showing an example of selection control of a catholyte path.

Hereinafter, selection control of a catholyte path will be described. FIG. 5 is a flowchart showing an example of the selection control of the catholyte path. This control flow is repeatedly executed by the control device 10 at predetermined timing. Note that FIG. 5 illustrates a case where the downflow is stopped after a predetermined time has elapsed.

First, the control device 10 determines whether an electrolytic state of the electrolytic bath 2 is a steady state (high-load operation state) based on signals received from the detector 98, the power supply 4, the power supply device 34, the concentration sensor 100, and the like (S101). In the case where the electrolytic state is the steady state (Y in S101), the control device 10 controls each cathode pump and each on-off valve so as to form the first path (upflow) of the catholyte or maintain the first path (S102), and ends this routine.

In the case where the electrolytic state is not the steady state (N in S101), the control device 10 determines whether the electrolytic bath 2 is in an operation stop state (S103). When the electrolytic bath is in the operation stop state (Y in S103), the control device 10 controls each cathode pump and each on-off valve so as to form the second path (downflow) of the catholyte (S104). Then, the control device 10 determines whether a predetermined time has elapsed from the formation of the second path (S105). When the predetermined time does not elapse (N in S105), the control device 10 repeats the determination in step S105. When the predetermined time elapses (Y in S105), the control device 10 controls each cathode pump and each on-off valve so as to form the third path (gas purge) of the catholyte (S106). Then, the control device 10 determines whether a predetermined time has elapsed from the formation of the third path (S107). When the predetermined time does not elapse (N in S107), the control device 10 repeats the determination in step S107. When the predetermined time elapses (Y in S107), the control device 10 ends this routine.

When the electrolytic bath is not in the operation stop state (N in S103), the control device 10 determines whether the electrolytic bath 2 is in the low-load operation state (S108). When the electrolytic bath is not in the low-load operation state (N in S108), the control device 10 ends this routine. When the electrolytic bath is in the low-load operation state (Y in S108), the control device 10 controls each cathode pump and each on-off valve so as to form the second path (downflow) of the catholyte (S109). Then, the control device 10 determines whether a predetermined time has elapsed from the formation of the second path (S110). When the predetermined time does not elapse (N in S110), the control device 10 repeats the determination in step S110. When the predetermined time elapses (Y in S110), the control device 10 controls each cathode pump and each on-off valve so as to form the first path of the catholyte (S111), and ends this routine.

As described above, the organic hydride production system 1 according to the present embodiment includes the electrolytic bath 2, the catholyte supply device 8, and the control device 10. The electrolytic bath 2 has the anode electrode 12 that oxidizes water in an anolyte to generate protons, the cathode electrode 14 that hydrogenates a substance to be hydrogenated in a catholyte with protons to generate an organic hydride, the anode chamber 16 that accommodates the anode electrode 12, the cathode chamber 18 that accommodates the cathode electrode 14, and the diaphragm 20 that partitions the anode chamber 16 and the cathode chamber 18 and moves the protons from the side of the anode chamber 16 to the side of the cathode chamber 18.

The catholyte supply device 8 has the catholyte tank 50 that stores the catholyte to be supplied to the cathode chamber 18, the first cathode pipe 58 (first pipe) that connects the catholyte tank 50 and the cathode chamber 18, and the second cathode pipe 60 and the sixth cathode pipe 68 (second pipe) that connect the catholyte tank 50 and the cathode chamber 18. The catholyte supply device 8 can switch between supply of the catholyte from the catholyte tank 50 to the cathode chamber through the first cathode pipe 58 and supply of the catholyte through the second cathode pipe 60 and the sixth cathode pipe 68. The control device 10 controls the catholyte supply device 8.

The electrolytic bath 2 has the first cathode opening 30 and the second cathode opening 32 that communicate with the inside and the outside of the cathode chamber 18. The first cathode opening 30 is disposed below the second cathode opening 32. The first cathode pipe 58 is connected to the first cathode opening 30, and the second cathode pipe 60 is connected to the second cathode opening 32. The sixth cathode pipe 68 is connected to the second cathode pipe 60 and the catholyte tank 50. Therefore, the catholyte supply device 8 can switch between the supply of the catholyte from the first cathode opening 30 to the cathode chamber 18 and the supply of the catholyte from the second cathode opening 32 to the cathode chamber 18. The control device 10 controls the catholyte supply device 8 so as to supply the catholyte from the first cathode opening 30 to the cathode chamber 18 in a steady state to form an upflow of the catholyte in the cathode chamber 18, and to supply the catholyte from the second cathode opening 32 to the cathode chamber 18 under a predetermined condition to form a downflow of the catholyte in the cathode chamber.

As described above, the hydrogen gas generated in the cathode electrode 14 can be efficiently discharged from the cathode chamber 18 by flowing the catholyte to the cathode chamber 18 in an upflow during the normal operation of the electrolytic bath 2. Therefore, it is possible to suppress the flow of the substance to be hydrogenated from being inhibited by the hydrogen gas. In addition, it is possible to suppress an increase in the internal pressure of the cathode chamber 18. In addition, the water accumulated in the cathode chamber 18 can be efficiently discharged from the cathode chamber 18 by flowing the catholyte to the cathode chamber 18 in a downflow under a predetermined condition. Therefore, it is possible to suppress the flow of the substance to be hydrogenated from being inhibited by the water staying in the cathode chamber 18. As described above, according to the organic hydride production system 1 of the present embodiment, the occurrence of the side reaction in the cathode electrode 14 can be suppressed, so that the Faraday efficiency can be improved.

The predetermined condition in the present embodiment includes operation stop of the electrolytic bath 2. During the operation stop of the electrolytic bath 2, no side reaction occurs in the cathode electrode 14, so that no hydrogen gas is generated. Therefore, when the operation of the electrolytic bath 2 is stopped or during the operation stop, the catholyte flows to the cathode chamber 18 in a downflow, so that it is possible to discharge the water in the cathode chamber 18 while suppressing the increase in the internal pressure of the cathode chamber 18 due to the hydrogen gas.

The predetermined condition of the present embodiment includes a state in which the amount of hydrogen gas generated during the operation of the electrolytic bath 2 is a predetermined value or less, which is derived from the relation between the current flowing through the electrolytic bath 2 and the concentration of the substance to be hydrogenated in the catholyte. If the amount of hydrogen gas generated is a predetermined value or less even when the electrolytic bath 2 is in operation, the hydrogen gas is less likely to be accumulated in the cathode chamber 18 even if the catholyte flows through the cathode chamber 18 in a downflow. Therefore, when the electrolytic bath 2 is in a state in which the amount of hydrogen gas generated is the predetermined value or less, it is possible to discharge the water in the cathode chamber 18 while suppressing an increase in the internal pressure of the cathode chamber 18 due to the hydrogen gas by causing the catholyte to flow to the cathode chamber 18 in a downflow.

In addition, the control device 10 of the present embodiment stops the downflow after a predetermined time elapses from switching to the downflow. As a result, it is possible to suppress an increase in power consumption of the organic hydride production system 1 due to wasteful continuation of the downflow. Further, the organic hydride production system 1 of the present embodiment includes the water amount sensor 96 that detects the amount of water discharged from the cathode chamber 18 by the downflow. In this case, the control device 10 may stop the downflow when the water amount sensor 96 detects that the amount of water has become the predetermined value or less.

Further, the organic hydride production system 1 according to the present embodiment includes the gas tank 56 and the sixth on-off valve 94 as a gas supply mechanism for supplying predetermined gas to the cathode chamber 18. The control device 10 causes the catholyte to flow in the cathode chamber 18 in the downflow when the electrolytic bath 2 is in the operation stop state, and controls the gas supply mechanism to supply the gas to the cathode chamber 18 after the downflow is stopped. As a result, the water in the cathode chamber 18 can be discharged more reliably. Note that the gas supply mechanism can be omitted.

Hereinabove, the embodiments of the present invention have been described in detail. The above-described embodiments are merely specific examples for carrying out the present invention. The contents of the embodiments do not limit the technical scope of the present invention, and many design changes such as changes, additions, and deletions of components can be made without departing from the spirit of the invention defined in the claims. A new embodiment to which the design change is made has the combined effect of each of the embodiment and the modification. In the above-described embodiment, the contents that can be subjected to such design changes are emphasized with notations such as "of the present embodiment" and "in the present embodiment", but the design changes are allowed even in the contents without such notations. Any combination of the above-described components is also effective as an aspect of the present invention.

The embodiments may also be specified as the items described below.

Item 1

An organic hydride production system (1) including:

an electrolytic bath (2) having a cathode chamber (18) accommodating a cathode electrode (14) for hydrogenating a substance to be hydrogenated in a catholyte with protons to generate an organic hydride, and a first cathode opening (30) and a second cathode opening (32) communicating with the inside and the outside of the cathode chamber (18), the first cathode opening (30) being disposed below the second cathode opening (32);

a catholyte supply device (8) capable of switching between supply of the catholyte from the first cathode opening (30) to the cathode chamber (18) and supply of the catholyte from the second cathode opening (32) to the cathode chamber (18); and a control device (10) controlling the catholyte supply device (8) so as to form an upflow of the catholyte in the cathode chamber (18) by supplying the catholyte from the first cathode opening (30) to the cathode chamber (18) in a steady state, and form a downflow of the catholyte in the cathode chamber (18) by supplying the catholyte from the second cathode opening (32) to the cathode chamber (18) under a predetermined condition.

Item 2

A control device (10) for an organic hydride production system (1) including an electrolytic bath (2) and a catholyte supply device (8), wherein the electrolytic bath (2) has a cathode chamber (18) accommodating a cathode electrode (14) for hydrogenating a substance to be hydrogenated in a catholyte with protons to generate an organic hydride, and a first cathode opening (30) and a second cathode opening (32) communicating with the inside and the outside of the cathode chamber (18), the first cathode opening (30) being disposed below the second cathode opening (32), the catholyte supply device (8) is capable of switching between supply of the catholyte from the first cathode opening (30) to the cathode chamber (18) and supply of the catholyte from the second cathode opening (32) to the cathode chamber (18), and the control device (10) controls the catholyte supply device (8) so as to form an upflow of the catholyte in the cathode chamber (18) by supplying the catholyte from the first cathode opening (30) to the cathode chamber (18) in a steady state, and form a downflow of the catholyte in the cathode chamber (18) by supplying the catholyte from the second cathode opening (32) to the cathode chamber (18) under a predetermined condition.

Item 3

A control method for an organic hydride production system (1) including an electrolytic bath (2) having a cathode chamber (18) accommodating a cathode electrode (14) for hydrogenating a substance to be hydrogenated in a catholyte with protons to generate an organic hydride, the control method including:

forming an upflow of the catholyte in the cathode chamber (18) in a steady state; and forming a downflow of the catholyte in the cathode chamber (18) under a predetermined condition.

What is claimed is:

1. An organic hydride production system comprising:

an electrolytic bath having a cathode chamber accommodating a cathode electrode for hydrogenating a substance to be hydrogenated in a catholyte with protons to generate an organic hydride, and a first cathode opening and a second cathode opening communicating with the inside and the outside of the cathode chamber, the first cathode opening being disposed below the second cathode opening;

a catholyte supply device capable of switching between supply of the catholyte from the first cathode opening to the cathode chamber and supply of the catholyte from the second cathode opening to the cathode chamber; and a control device structured to control the catholyte supply device so as to form an upflow of the catholyte in the cathode chamber by supplying the catholyte from the first cathode opening to the cathode chamber in a steady state, and form a downflow of the catholyte in the cathode chamber by supplying the catholyte from the second cathode opening to the cathode chamber under a predetermined condition.

2. The organic hydride production system according to claim 1, wherein the predetermined condition includes operation stop of the electrolytic bath.

3. The organic hydride production system according to claim 1, wherein a side reaction in which hydrogen gas is generated occurs in the cathode electrode, and the predetermined condition includes a state in which an amount of the hydrogen gas generated during operation of the electrolytic bath becomes a predetermined value or less, which is derived from a relation between a current flowing through the electrolytic bath and a concentration of the substance to be hydrogenated in the catholyte.

4. The organic hydride production system according to claim 1, wherein the control device stops the downflow after a predetermined time elapses from switching to the downflow.

5. The organic hydride production system according to claim 1, wherein the electrolytic bath has an anode chamber that accommodates an anode electrode that oxidizes water in an anolyte to generate protons, the protons move together with the water from the side of the anode chamber to the side of the cathode chamber, the organic hydride production system comprises a water amount sensor structured to detect an amount of the water discharged from the cathode chamber by the downflow, and the control device stops the downflow when it is detected by the water amount sensor that the amount of water has become the predetermined value or less.

6. The organic hydride production system according to claim 4, wherein the organic hydride production system comprises a gas supply mechanism structured to supply predetermined gas to the cathode chamber, the predetermined condition is operation stop of the electrolytic bath, and the control device controls the gas supply mechanism to supply the gas to the cathode chamber after the downflow is stopped.

7. A control device for an organic hydride production system including an electrolytic bath and a catholyte supply device, wherein the electrolytic bath has a cathode chamber accommodating a cathode electrode for hydrogenating a substance to be hydrogenated in a catholyte with protons to generate an organic hydride, and a first cathode opening and a second cathode opening communicating with the inside and the outside of the cathode chamber, the first cathode opening being disposed below the second cathode opening, the catholyte supply device is capable of switching between supply of the catholyte from the first cathode opening to the cathode chamber and supply of the catholyte from the second cathode opening to the cathode chamber, and the control device controls the catholyte supply device so as to form an upflow of the catholyte in the cathode chamber by supplying the catholyte from the first cathode opening to the cathode chamber in a steady state, and form a downflow of the catholyte in the cathode chamber by supplying the catholyte from the second cathode opening to the cathode chamber under a predetermined condition.

8. A control method for an organic hydride production system including an electrolytic bath having a cathode chamber accommodating a cathode electrode for hydrogenating a substance to be hydrogenated in a catholyte with protons to generate an organic hydride, the control method comprising:

forming an upflow of the catholyte in the cathode chamber in a steady state; and forming a downflow of the catholyte in the cathode chamber under a predetermined condition.

* * * * *